US007317891B2

(12) United States Patent
Tohata

(10) Patent No.: US 7,317,891 B2
(45) Date of Patent: Jan. 8, 2008

(54) IMAGE FORMING APPARATUS AND METHOD FOR FORMING IMAGE WITH FIXING AND CLEANING CAPABILITY

(75) Inventor: Nobuo Tohata, Sunto-gun (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 205 days.

(21) Appl. No.: 11/166,097

(22) Filed: Jun. 27, 2005

(65) Prior Publication Data

US 2006/0291918 A1 Dec. 28, 2006

(51) Int. Cl.
*G03G 15/20* (2006.01)

(52) U.S. Cl. ..... 399/327

(58) Field of Classification Search ..... 399/327, 399/328, 329, 330, 333

See application file for complete search history.

(56) References Cited

U.S. PATENT DOCUMENTS 5,678,134 A * 10/1997 Miki et al. ..... 399/71

FOREIGN PATENT DOCUMENTS

JP 61-067070 A 4/1986
JP 10-010910 A 1/1998

* cited by examiner

*Primary Examiner*—Hoang Ngo
(74) *Attorney, Agent, or Firm*—Foley & Lardner LLP

(57) ABSTRACT

An image forming apparatus comprising a fixing portion provided with a cleaning member having a resinous covering layer comprising a resin which is of the same series as a binder resin and has an MI which is not less than 1.3 times as high as that of the binder resin, or the cleaning member being provided with a heating mechanism for heating the cleaning member as a layer of dirt that has been deposited thereon is increased to a predetermined thickness or as the layer of dirt and the surface temperature of the cleaning member become higher than a predetermined level.

18 Claims, 3 Drawing Sheets

IMAGE FORMING APPARATUS AND METHOD FOR FORMING IMAGE WITH FIXING AND CLEANING CAPABILITY

BACKGROUND OF THE INVENTION

This invention relates to an image forming apparatus for developing an electrostatic image or a magnetic latent image in an electrophotographic method, an electrostatic printing method, or a magnetic recording method. In particular, this invention relates to an image forming apparatus comprising a fixing device provided with a cleaning device.

In the heat fixing system using a roller for copying machines and multifunction peripherals (MFPs) of recent years, various kinds of cleaning rollers such as a felt roller, a metal roller, etc. are employed as a cleaning member. Among them, a metal roller having a surface coating of the same resin or the same series of resin as that of toner as described in Japanese Laid-open Patent Publication (Kokai) No. 61-67070 (1986) for example is excellent in cleanability to toner dirt in the contamination of fixing.

However, since the cause for generating image noise in recent years is mainly due to paper dust which will be generated as cheap paper is used in large quantities, a cleaning roller having a resin coating is accompanied with the problem that it can be easily covered, on its surface, with the paper dust within a short period of time to shorten its useful life because of its excellent cleanability.

BRIEF SUMMARY OF THE INVENTION

The present invention has been made under the aforementioned circumstances and hence, an object of the present invention is to provide an image forming apparatus and a method for forming an image which are capable of preventing the fixing device from being easily contaminated and also capable of forming excellent images.

According to a first aspect of the present invention, there is provided an image forming apparatus which comprises a developing portion for feeding a developing agent comprising a coloring agent and a binder resin to an electrostatic latent image formed on an image carrier to thereby form a developing agent image on the image carrier, a transferring portion for transferring the developing agent image to a recording material, and a fixing portion provided with a fixing member for fixing the developing agent image on the recording material and with a cleaning member which is enabled to contact with the fixing member; wherein the cleaning member is provided, on the surface thereof which is adapted to be contacted with the fixing member, with a resinous covering layer comprising a resin which is of the same series as the binder resin and has a melt index which is not less than 1.3 times as high as that of the binder resin.

According to a second aspect of the present invention, there is provided an image forming apparatus which comprises a developing portion for feeding a developing agent comprising a coloring agent and a binder resin to an electrostatic latent image formed on an image carrier to thereby form a developing agent image on the image carrier, a transferring portion for transferring the developing agent image to a recording material, a fixing member for fixing the developing agent image on the recording material, and a cleaning member which is enabled to contact with the fixing member; wherein the cleaning member is provided with a heating mechanism for heating the cleaning member as a layer of dirt that has been deposited on the surface of the cleaning member is increased to a predetermined thickness.

According to a third aspect of the present invention, there is provided an image forming apparatus which comprises a developing portion for feeding a developing agent comprising a coloring agent and a binder resin to an electrostatic latent image formed on an image carrier to thereby form a developing agent image on the image carrier, a transferring portion for transferring the developing agent image to a recording material, a fixing member for fixing the developing agent image on the recording material, and a cleaning member which is enabled to contact with the fixing member; wherein the cleaning member is provided with a heating mechanism for heating the cleaning member as a layer of dirt that has been deposited on the surface of the cleaning member is increased to a predetermined thickness and also as the temperature of surface of the cleaning member becomes higher than a predetermined level.

According to a fourth aspect of the present invention, there is provided a method of forming image which comprises: developing an image formed of a developing agent on an image carrier by feeding a developing agent comprising a coloring agent and a binder resin to an electrostatic latent image formed the image carrier; transferring the developing agent image to a recording material; fixing the developing agent image on a recording material by making use of a fixing member; cleaning dirt on the fixing member by a cleaning member which is enabled to contact with the fixing member and provided with a heating mechanism; and heating the cleaning member as a layer of dirt that has been deposited on the surface of the cleaning member is increased to a predetermined thickness.

According to a fifth aspect of the present invention, there is provided a method of forming image which comprises: developing an image formed of a developing agent on an image carrier by feeding a developing agent comprising a coloring agent and a binder resin to an electrostatic latent image formed in advance on the image carrier; transferring the developing agent image to a recording material; fixing the developing agent image on a recording material by making use of a fixing member; and heating the cleaning member as a layer of dirt that has been deposited on the surface of the cleaning member is increased to a predetermined thickness and also as the temperature of surface of the cleaning member becomes higher than a predetermined level.

According to a sixth aspect of the present invention, there is provided a method of forming image which comprises: developing an image formed of a developing agent on an image carrier by feeding a developing agent comprising a coloring agent and a binder resin to an electrostatic latent image formed in advance on the image carrier; transferring the developing agent image to a recording material; fixing the developing agent image on a recording material by making use of a fixing member; and heating the cleaning member as a layer of dirt that has been deposited on the surface of the cleaning member is increased to a predetermined thickness and also as the temperature of surface of the cleaning member becomes higher than a predetermined level.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Figure 1:
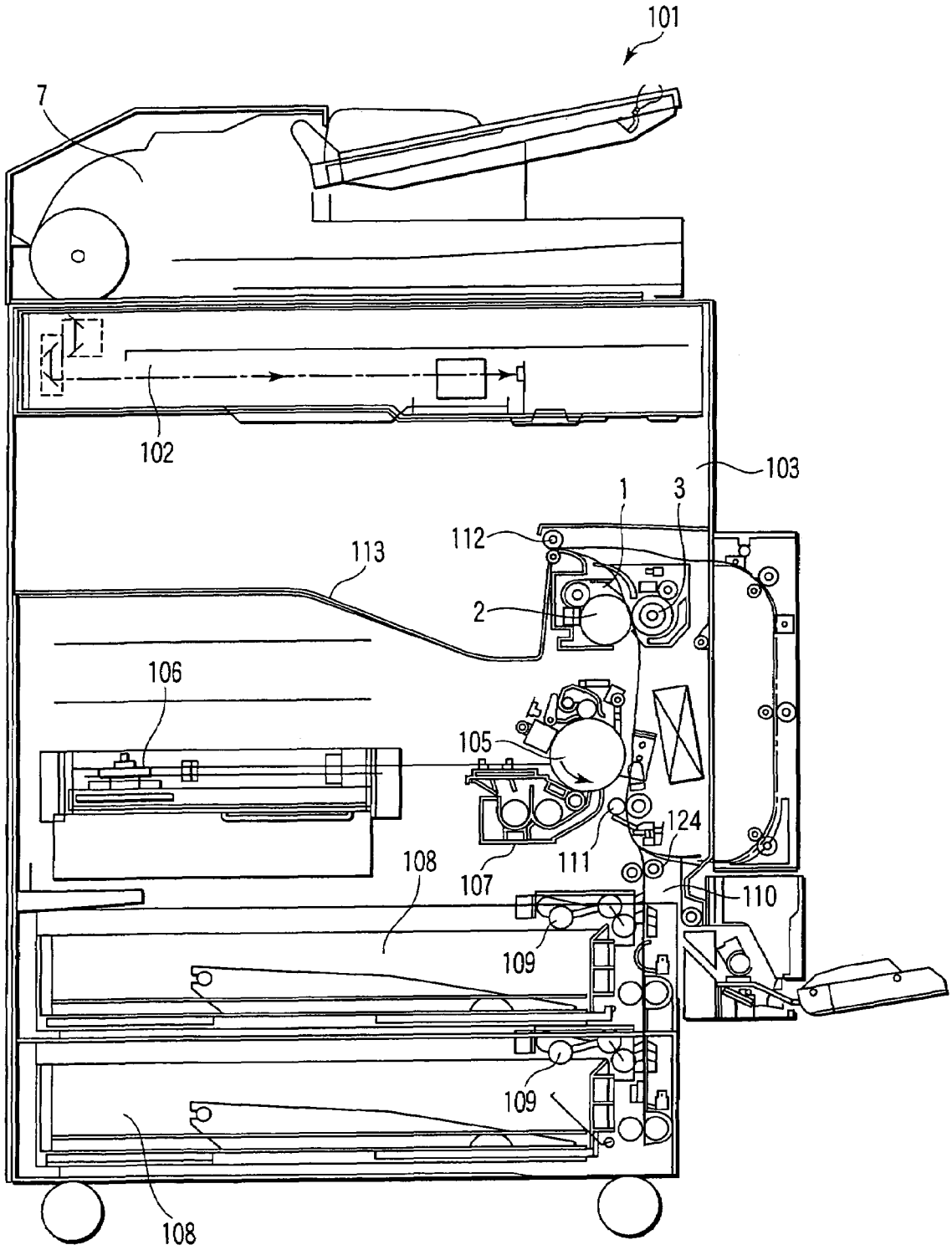
FIG. 1 is a diagram schematically illustrating one example of the structure of image forming apparatus according to the present invention.

The image forming apparatus according to the present invention can be classified into the following three aspects, i.e. a first aspect, a second aspect and a third aspect.

An image forming apparatus according to the first aspect comprises, as a basic structure, a developing portion for feeding a developing agent comprising a coloring agent and a binder resin to an electrostatic latent image formed on an image carrier to thereby form a developing agent image on the image carrier, a transferring portion for transferring the developing agent image to a recording material, and a fixing portion provided with a fixing member for fixing the developing agent image on the recording material and with a cleaning member which is enabled to contact with the fixing member; wherein the cleaning member is provided, on the surface thereof which is adapted to be contacted with the fixing member, with a resinous covering layer comprising a resin which is of the same series as the binder resin and has a melt index which is not less than 1.3 times as high as that of the binder resin.

An image forming apparatus according to the second aspect is constituted by the aforementioned basic structure, wherein the cleaning member is provided with a heating mechanism for heating the cleaning member as a layer of dirt that has been deposited on the surface of the cleaning member is increased to a predetermined thickness.

An image forming apparatus according to the third aspect is constituted by the aforementioned basic structure, wherein the cleaning member is provided with a heating mechanism for heating the cleaning member as a layer of dirt that has been deposited on the surface of the cleaning member is increased to a predetermined thickness and also as the temperature of surface of the cleaning member becomes higher than a predetermined level.

The method of forming image according to the present invention can be classified into the following three aspects, i.e. a fourth aspect, a fifth aspect and a six aspect, wherein the aforementioned apparatuses according to the first aspect, the second aspect and the third aspect are employed, respectively.

A method of forming image according to the fourth aspect of the present invention comprises, as a basic process, the steps of: developing an image formed of a developing agent on an image carrier by feeding a developing agent comprising a coloring agent and a binder resin to an electrostatic latent image formed on the image carrier; transferring the developing agent image to a recording material; fixing the developing agent image on a recording material by making use of a fixing member; and cleaning dirt on the fixing member by means of a cleaning member which is enabled to contact with the fixing member; wherein the cleaning member is provided, on the surface thereof which is adapted to be contacted with the fixing member, with a resinous covering layer comprising a resin which is of the same series as the binder resin and has a melt index which is not less than 1.3 times as high as that of the binder resin.

A method of forming image according to the fifth aspect of the present invention is constituted by the aforementioned basic process and that it further includes a step of heating the cleaning member as a layer of dirt that has been deposited on the surface of the cleaning member is increased to a predetermined thickness.

A method of forming image according to the sixth aspect of the present invention is constituted by the aforementioned basic process and that it further includes a step of heating the cleaning member as a layer of dirt that has been deposited on the surface of the cleaning member is increased to a predetermined thickness and also as the temperature of surface of the cleaning member becomes higher than a predetermined level.

Next, the present invention will be further illustrated in detail with reference to drawings.

FIG. 1 shows a diagram schematically illustrating one example of the structure of image forming apparatus according to the present invention.

As shown in FIG. 1, this image forming apparatus 101 is constituted by a scanner 102 which is an image reader designed to pick up an object image as a contrast of light and to photoelectrically convert the contrast of light into image signals, and by an image-forming portion 103 which is designed to create an image corresponding to the image signals supplied from the scanner 102 or other external devices and to fix the image to a sheet of paper P as a recording material.

The image-forming portion 103 comprises a cylindrical photoreceptor drum 105 provided, on its external circumferential surface, with a photoreceptor which is constructed such that when the photoreceptor is irradiated with light, only the irradiated portions thereof are caused to change in electric potential to form an electrostatic latent image that can be retained for a predetermined period of time.

Specifically, the photoreceptor drum 105 is designed to receive image information, through the exposure thereof, from an exposure apparatus 106 which is capable of emitting a laser beam varied in light intensity in conformity with the image information to be supplied from the scanner 102 or other external devices. As a result, an electrostatic latent image, i.e. an image is created on the surface of the photoreceptor drum 105. The image created on the surface of the photoreceptor drum 105 is then visualized as a toner containing a coloring agent and a binder resin and kept in a developing device 107 is selectively fed to the electrostatic latent image.

The toner image, which is developed on the surface of the photoreceptor drum 105 through the supply of toner from the developing device 107, is then transferred onto a sheet of paper P which has been delivered from a paper delivering portion to be explained herein after as an electric voltage required for the transfer of image is applied to the electrostatic image from a transfer device (the details of which are omitted herein). The image formed of toner that has been transferred onto a sheet of paper P is subjected to heat and pressure from a fixing device 1, thereby melting the toner and fixing the image to the paper P by the pressure provided by the fixing device 1.

In this image forming device described above, image signals are fed from the scanner 102 or other external devices, and, based on the image signals, a laser beam is irradiated from the exposure apparatus 106 to predetermined regions of the photoreceptor drum 105 which has been electrified to a predetermined electric potential in advance. As a result, an electrostatic latent image is formed on the surface of photoreceptor drum 105 in conformity with the image to be reproduced.

The electrostatic latent image formed on the surface of photoreceptor drum 105 is developed as toner is selectively provided from the developing device 107, thus enabling the latent image to convert into a toner image (not shown).

The toner image formed on the photoreceptor drum 105 is then transferred on the paper P which has been delivered to a predetermined transferring position facing a transferring device 124. The paper P is picked up one by one from a paper cassette 108 by means of a pick-up roller 109 for instance and delivered to an aligning roller 111. Further, by means of this aligning roller 111, the delivery timing of paper P is adjusted in the delivery of paper P to the transferring position.

The toner that has been transferred onto the paper P by means of the transferring device is moved to the fixing device 1, in which the toner is melted and, at the same time, pressurized, enabling the toner image to be fixed to the paper P.

Figure 2:
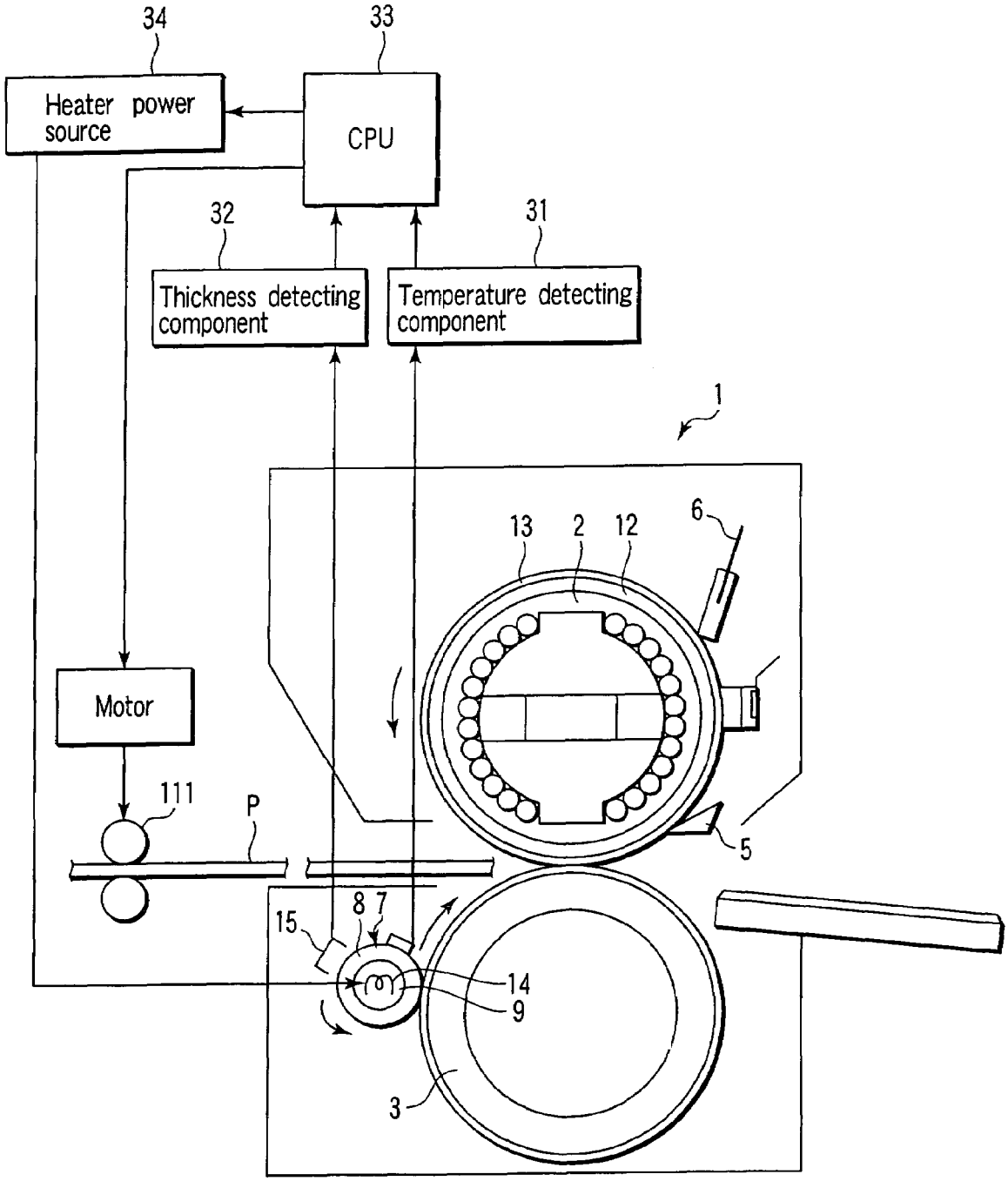
FIG. 2 is a diagram schematically illustrating the fixing device shown in FIG. 1.

FIG. 2 is a diagram schematically illustrating one example of the fixing device to be utilized in the image forming apparatus shown in FIG. 1.

The fixing device 1 is composed of a heat (fixing) roller 2 having a diameter of about 50 mm, and a press roller 3 having a diameter of about 50 mm.

The fixing roller 2 is composed, for example, of a hollow cylindrical main body 12 made from a metal, e.g., iron, having a thickness of about 1.5 mm, and a parting layer 13 made of fluororesin represented by polytetrafluoroethylene such as Teflon, which is deposited on the surface of the main body 12 to a predetermined thickness.

As for the materials for the fixing roller 2, it is possible to employ such as stainless steel, aluminum or an alloy of these metals. The length of the fixing roller 12 is about 340 mm in this example.

By the way, it is also possible, in place of the fixing roller 2, to employ a metallic film configured into an endless belt and made of a sheet comprising a heat resistant resin film on which a metal is deposited to a predetermined thickness.

The press roller 3 is an elastic roller composed of a shaft having a predetermined diameter and covered with a layer of silicone rubber or fluorinated rubber having a predetermined thickness. The length of the press roller 3 is about 320 mm.

The press roller 3 is disposed approximately parallel with the axis of the fixing roller 2 and linearly press-contacted with the surface of the fixing roller 2. As a result, part of the outer circumferential surface of the fixing roller 3 is caused to elastically deform, thereby defining a prescribed nip between these rollers. When a metallic film is employed in place of the fixing roller 2, the nip may be formed on the metallic film side.

The fixing roller 2 is enabled to rotate in the direction as indicated by an arrow at approximately constant velocity by means of the driving force to be supplied from a fixing motor or from a drum motor employed for rotating the photoreceptor drum 105. Since the press roller 3 is enabled to contact with the fixing roller 2 by a predetermined pressure imposed on the press roller 3 by a pressing mechanism, when the fixing roller 2 is rotated, the press roller 3 is caused to rotate in a direction opposite to the rotating direction of the fixing roller 2.

A region where the fixing roller 2 and the press roller 3 are contacted with each other on the circumferential surface of the fixing roller 2 is generally referred to as a nip. On the downstream side of the nip in the rotating direction of the fixing roller 2 and in the vicinity of the nip, there is disposed a releasing claw 5 for separating the paper P from the fixing roller 2 as the paper P has passed through the nip.

Around the circumferential surface of the fixing roller 2, there are disposed, on the down-stream side the releasing claw 5, a temperature-detecting element 6 and a cleaner 7 in the mentioned order in the rotational direction of the fixing roller 2.

The fixing roller 2 is provided therein an exciting coil 11 which is capable of generating an eddy current in the material constituting the fixing roller 2.

The temperature-detecting element 6 is used to detect the temperature on the outer circumferential surface the fixing roller 2. The temperature thus detected is utilized for controlling the supply and suspension of electric current to the exciting coil 11.

The temperature-detecting element 6 is formed of a thermistor for example and at least one thermistor is positioned at approximately the center lengthwise of the fixing roller 2.

The thermistor 6 can be disposed at any suitable location on the circumferential surface of the fixing roller 2, i.e. at a location where the phase as viewed from the cross-sectional direction of the fixing roller 2 is not governed by specific conditions. By the way, the number of the thermistor may be two or more.

The cleaner 7 is employed for the removal of the toner that may be adhered onto a layer of fluorinated resin formed, to a predetermined thickness, on the outer peripheral portion of the press roller, the removal of paper dust that may arise from paper employed as a recording material, or the removal of dirt such as dust which may adhere to the press roller 3 after being floated in the apparatus. The cleaner 7 comprises a supporting member 9 having a cylindrical configuration for example and provided therein with a built-in heating mechanism 14, and a resinous covering layer 8 covering the circumferential surface of the supporting member 9. By the way, the cleaning member may be contacted with the surface of the press roller 3 and enabled to rotate together with the press roller 3 or may be press-contacted with the outer circumferential surface of the press roller 3 at a predetermined pressure.

A thermistor 16 for measuring the temperature on the circumferential surface of the cleaner 7 as well as an optical thickness gage 15 for example for measuring the thickness of the dirt layer deposited on the cleaner 7 may be disposed over the cleaner. The thermistor 16 may be connected with a temperature detecting component 31, and the optical thickness gage 15 may be connected with a thickness detecting component 32.

As for the supporting member of cleaner 7, it is possible to employ a core bar having an outer diameter of 10 to 20 mm for example and made of a metal such aluminum, iron, copper, etc.

As for the resin to be employed for the resinous covering layer, it is possible to employ, for example, styrene-acrylic resin, polystyrene resin, polyester resin, styrene-butadiene resin, epoxy resin, polyimide, polycarbonate, polyamide, etc.

The resinous covering layer may be also formed of a resin of the same series as the binder resin included as a component in the toner.

More preferably, the resin to be employed for the resinous covering layer has a melt index which is not less than 1.3 times as high as the melt index of the binder resin. Most preferably, the melt index of the resin to be employed for the resinous covering layer should be confined within the range of 1.3 to 2.0 times as high as the melt index of the binder resin.

If the melt index of the resin to be employed for the resinous covering layer is less than 1.3 times as high as the melt index of the binder resin, the dirt-uptake (uptake of paper dust for example) efficiency of the cleaner tends to deteriorate. On the other hand, if the melt index of the resin to be employed for the resinous covering layer is more than 2.0 times as high as the melt index of the binder resin, dirt such as paper dust that has been once entrapped by the resin tends to be easily released from the cleaner.

The term "resin of the same series" employed herein includes any kind of resins as long as the repeating unit thereof is the same.

Since the resins of the same series are excellent in affinity with each other, the toner comprising the resin of the same series and adhered to the surface of the fixing roller can be effectively transferred to the resinous covering layer by contacting the resinous covering layer with the toner, thereby removing the toner from the fixing roller.

As for the resin to be employed as the resinous covering layer or as the binder resin, it is possible to preferably employ at least one kind of resin selected from the group consisting of styrene-acrylic resin, polyester resin, epoxy resin and polyamide resin. More preferable examples thereof would be styrene-acrylic resin and polyester resin.

It is further preferable to employ styrene-acrylic resin having a glass transition point (Tg) of 50-75° C. and a melt index (MI) of 1-20 (g/10 min, 110° C.) and polyester resin having a glass transition point (Tg) of 50-77° C. and a melt index (MI) of 1-20 (g/10 min, 110° C.).

The resinous covering layer can be created by a process, for example, wherein one of the aforementioned resins is dissolved in a solvent such as toluene and xylene to obtain a solution having a predetermined viscosity, which is then coated on a core bar by means of dipping method or spray coating method to form a layer of resin, which is then allowed to dry to obtain the resinous covering layer. In this case, the film thickness of the resin to be coated may be within the range of 2 to 200 μm, more preferably 10 to 50 μm. When the film thickness of the resin is 10 μm or more, the thickness of the resin layer becomes larger than an average particle diameter of toner, thereby making it possible to further enhance the uptake efficiency of toner. Further, when the film thickness of the resin is confined to not more than 50 μm, the uniformity of film thickness can be more easily achieved.

The heating mechanism shown in FIG. 2 is designed to heat the cleaner 7 so as to remove a layer of dirt deposited on the surface of the cleaner 7 when the thickness of this dirt layer becomes larger than a predetermined thickness.

When paper feeding is continuously performed with the temperature of fixing roller being set at 185° C., the temperature of the press roller as well as the temperature of the cleaner is caused to rise correspondingly with the feeding of paper. Namely, as the threading speed becomes higher, the temperature of these members becomes higher correspondingly, so that the temperature of press roller would be raised up to 150° C. at maximum for example and the temperature of cleaner would be raised up to 100° C. at maximum for example. When the viscosity of the resinous covering layer coated on the surface of cleaner is decreased around this maximum temperature, the effect of cleaning would be weakened and hence the toner that cannot be removed from the fixing roller would be likely to become dirt on an image. In the present invention, in order to prevent the aforementioned phenomenon, the cleaner is heated to a predetermined temperature so as to forcibly discharge the dirt therefrom at the moment a short time before the temperature of the cleaner is raised to become the aforementioned maximum temperature.

Figure 3:
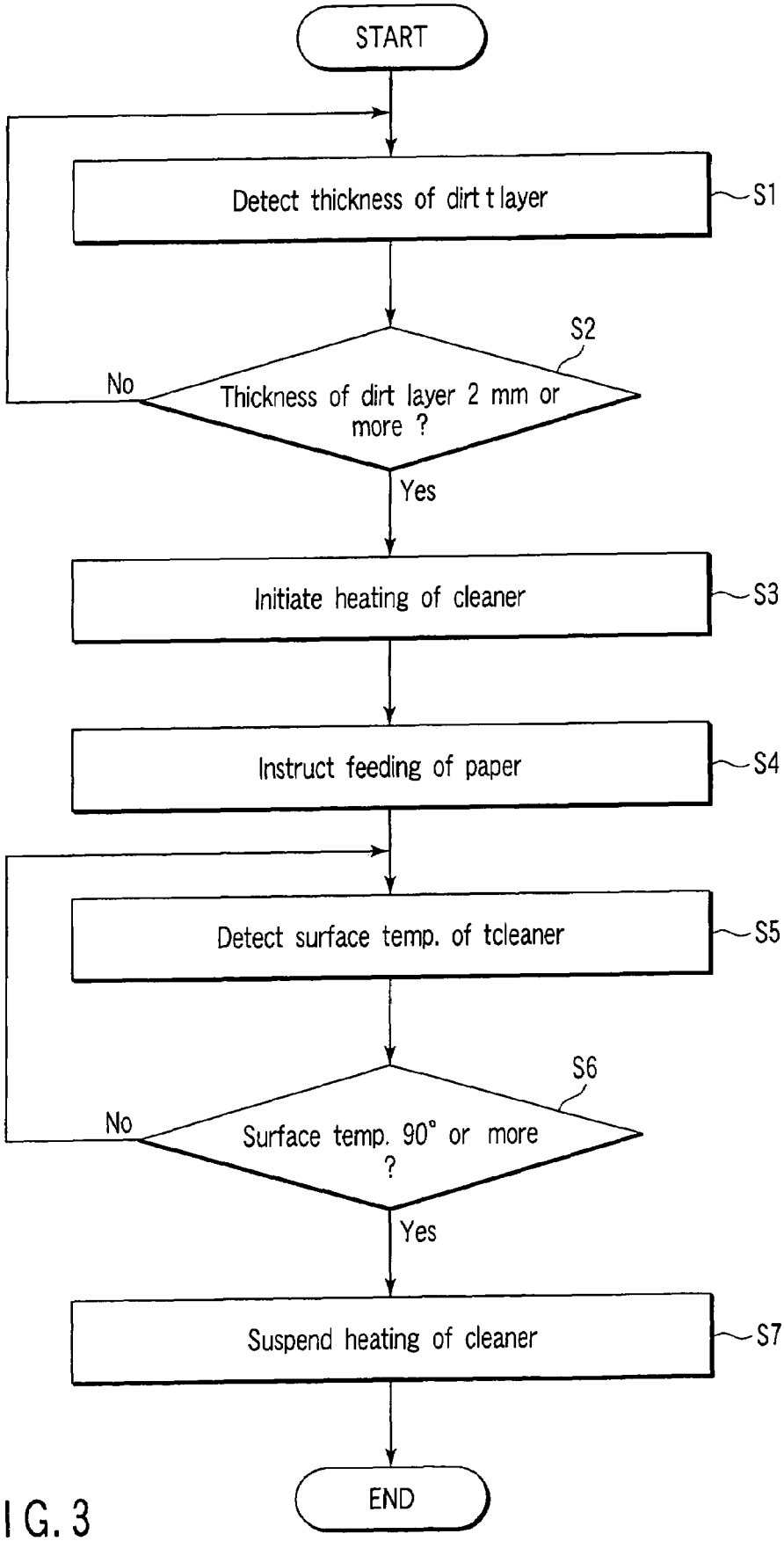
FIG. 3 is a flowchart illustrating one example of the procedure of heating treatment of the cleaning member.

FIG. 3 shows a flowchart representing one example of the heat treatment procedure of the cleaner.

First of all, by making use of the optical thickness gage 15, the thickness of dirt layer is measured and, based on the signals from the optical thickness gage 15, the thickness of dirt layer is detected by the thickness detecting component 32 (S1).

Then, by means of a CPU 33 which is connected with the temperature detecting component 31 and also with the thickness detecting component 32 and based on the signals representing the thickness of the dirt layer and detected by the thickness detecting component 32, it is determined if this detected thickness is higher than a predetermined thickness, e.g. 2 mm or more (S2).

This predetermined thickness is preferably confined within the range of 2 mm to 3 mm.

When the thickness of the dirt layer is found to be 2 mm or more, the power source 34 connected with the CPU 33 is turned on, thereby actuating the heating mechanism 14 as a forced cleaning mode and initiating the heating of the cleaner 7 (S3).

Concurrent with the initiation of heating, an aligning roller 111 which is connected with the CPU 33 and kept in stand-by for feeding paper P from a paper feed cassette is now instructed to initiate the feeding of paper P (S4).

On this occasion, the dirt layer is permitted to melt and transfer from the surface of the heated cleaner 7 to the surface of fixing roller 2. Then, the forced paper feeding of paper P is initiated with the timing that as this dirt layer passes through the nip, the paper P is permitted to concurrently pass through the nip of the fixing device. As a result, the dirt layer adhering to the surface of fixing roller 2 is transferred to the surface of paper P, thus removing the dirt layer from the fixing roller 2.

Further, upon receiving the signals from the thermistor 16, the temperature detecting component 31 is actuated to detect the temperature of the surface of cleaner 7 that has been heated (S5).

Upon receiving the signals of temperature thus detected from the temperature detecting component 31, the CPU 33 is actuated to determine if the temperature of the surface of cleaner 7 is higher than a predetermined temperature, e.g. 90° C. (S6).

In this case, the surface of cleaner 7 should preferably be at least 1.5 times as high as the Tg of binder resin.

When the temperature of the surface of cleaner 7 is 90° C. or more, a signal to turn off the heating mechanism 14 is instructed to a heater power source 34, thus finishing the forced cleaning mode (S7).

Further, the heating mechanism 14 is enabled to heat-treat the cleaner 7 when the thickness of the dirt layer deposited on the surface of cleaner 7 is increased higher than a predetermined level and also the temperature of the surface of cleaner 7 is increased higher than a predetermined level.

Next, another example to control the heating mechanism 14 of the cleaner will be illustrated.

In this case, the heating mechanism 14 is controlled in the same manner as the aforementioned example except that, in place of controlling the heating mechanism 14 in such a manner that when it is determined in the CPU 33 that the thickness of dirt layer is larger than a predetermined thickness, e.g., 2 mm or more, the power-on of the heating mechanism 14 is instructed from the CPU 33 to the power circuit and concurrently the feeding of paper is instructed to the aligning roller 111, it is now controlled such that when the thickness of dirt layer is determined larger than a predetermined thickness, e.g., 1 mm or more, and the temperature of surface of cleaner is determined higher than a predetermined temperature, e.g. 80° C. or more, the power-on of the heating mechanism 14 is instructed from the CPU 33 to the power circuit 34 and concurrently the feeding of paper is instructed to the aligning roller 111.

The predetermined thickness in this case may be confined, for example, within the range of 1 to 4 mm for example, and also the predetermined temperature may be confined, for example, to at least 1.3 times as high as the Tg of the binder resin, more preferably within the range of 80 to 90° C.

As for the binder resin to be employed in the present invention, it is possible to employ a thermosetting resin such as modified or unmodified silicone resin, thermosetting acrylic resin, thermosetting styrene-acrylic resin, phenol resin, urethane resin, thermosetting polyester resin, epoxy resin, amino resin, etc.; and a thermoplastic resin such as thermoplastic acrylic resin, thermoplastic styrene-acrylic resin, olefin-based copolymer resin, olefin-based copolymer wax, low-melting point polyamide resin, low-melting point polyester resin, etc.

As for the coloring agent to be employed in the present invention, it is possible to employ inorganic pigments such as carbon black, titanium white, titanium yellow, Ultramarine Blue, cobalt blue, iron oxide red, etc.; organic pigments such as quinophthalone yellow, isoindolinone yellow, perinone orange, perylene maroon, Rhodamine 6G Lake, quinacridone red, Rose Bengal, copper phthalocyanine blue, copper phthalocyanine green, diketopyrrolopyrrole, etc.; various kinds of oil-soluble dyes and disperse dyes such as azo dye, quinophthalone dye, anthraquinone dye, phthalocyanine dye, indophenolic dye, indoaniline, etc.; rosin; and triaryl methane-based dye which is modified with resin such as rosin-modified phenol, rosin-modified maleic acid, etc.

The developing agent to be employed in the present invention includes toner particle containing a coloring agent and a binder resin, and toner having, as required, an additive adsorbed on the surface of toner particle. In the case of a two-component developing agent, it includes a mixture comprising any of the aforementioned toners, and a carrier.

EXAMPLES

Next, the present invention will be more specifically explained with reference to examples.

Tests 1-6

A toner particle material having the following composition was prepared.

A composition of toner particle material:

Binder resins shown in the following Table 1: 100 parts by weight

| | |
|---|---|
| Carbon black: | 5 parts by weight |
| Cr-complex azo dye: | 1 part by weight |
| Polypropylene wax: | 3 parts by weight |
| Polyethylene wax: | 1 part by weight |

The toner particle material described above was mixed by making use of a Naughter mixer and then, by making use of a twin-screw extruder, the resultant mixture was melted and kneaded. The kneaded mass thus obtained was cooled and coarsely crushed by means of a hammer mill, which was followed by fine pulverization using a jet mill. The resultant particles were subjected to fine classification using a separator to obtain toner particles having an average particle diameter of 9.5 μm.

To 100 parts by weight of the toner particles, 0.5 parts by weight of hydrophobic silica were mixed by using Henshel mixer to obtain a toner. To 100 parts by weight of the toner, 1,550 parts by weight of ferrite carrier were added and mixed to obtain a two-component agent.

Various kinds of cleaners each having a resin covering as shown in the following Table 2 were installed in the fixing device of the image forming apparatus each having the same structures as shown in FIGS. 1 and 2. Then, by making use of the developing agent thus obtained, the formation of images was performed without actuating the heating mechanism.

By making use of this image forming apparatus, the reproduction of image was repeated until the cleaner of the fixing roller is saturated to generate an image contaminated with dirt, thereby counting the number of papers without dirt to investigate the cleaning properties of the cleaners. The results obtained are shown in the following Table 2.

TABLE 1

| | Binder resin | | |
|---|---|---|---|
| | Resin | Tg (° C.) | MI (g/10 min, 110° C.) |
| Test 1 | Styrene/acryl | 60 | 3 |
| Test 2 | Polyester | 58 | 7 |
| Test 3 | Styrene/acryl | 60 | 3 |
| Test 4 | Styrene/acryl | 60 | 3 |
| Test 5 | Polyester | 58 | 7 |
| Test 6 | Polyester | 58 | 7 |

TABLE 2

| | Cleaner resin-covering layer | | |
|---|---|---|---|
| | Resin | Tg (° C.) | Cleanability (×1000 times) |
| Test 1 | Styrene/acryl | 5 | 200 |
| Test 2 | Polyester | 10 | 200 |
| Test 3 | No resin-covering | — | 60 |
| Test 4 | Styrene/acryl | 3 | 100 |
| Test 5 | No resin-covering | — | 60 |
| Test 6 | Polyester | 7 | 100 |

As shown in Table 2, when a resinous covering layer was not provided on the outer circumferential surface of cleaner as in the cases of Tests 3 and 5, an image with dirt was generated when the reproduction of image was repeated 6,0000 times. Further, even if the cleaner was covered with a resin of the same series as the binder resin, an image with dirt was generated when the reproduction of image was repeated 100,000 times when the melt index of the resin was less than 1.3 times as high as that of binder resin as seen in Tests 4 and 6. However, when the melt index of the resin was not less than 1.3 times as high as that of binder resin as seen in Tests 1 and 2, it was possible to suppress the generation of image with dirt even if the reproduction of image was repeated 200,000 times, thus making it possible to greatly enhance the cleaning properties of the cleaner.

Tests 7-9

Samples of developing agents were obtained by repeating the same procedures as in the case of Test 1 except that the binder resins as shown in the following Table 3 were employed in place of the binder resins described in the above Table 1.

Various kinds of cleaners each having a resin covering as shown in the following Table 3 were installed in the fixing device of the image forming apparatus each having the same structures as shown in FIGS. 1 and 2. Then, by making use of the developing agent thus obtained, the formation of images was performed with actuating the heating mechanism.

In this case, the heating mechanism was employed, so that when it was detected that the dirt layer deposited on the surface of cleaner was increased to a thickness of not less than 2 mm, a forced cleaning mode was switched on to thereby heat the cleaner until the surface temperature thereof was raised to 90° C. and, at the same time, the paper was forcibly fed to discharge the dirt layer onto the paper.

The actual thickness of the dirt layer when the dirt layer was detected as having a thickness of not. less than 2 mm, the surface temperature of cleaner on this occasion, and the surface temperature of cleaner after the detection are respectively shown in Table 4.

By making use of this image forming apparatus, the cleaning properties of the cleaners were investigated as follows. Namely, the reproduction of image was repeated 1,000 times by continuously feeding a sheet of paper having an ordinary size of A4 in the longitudinal direction thereof to investigate the generation of dirt on the rear surface of paper. When it was impossible to visually recognize the dirt, the test sample was marked by ○ and when it was possible to visually recognize the dirt, the test sample was marked by X. The results obtained are also shown in the following Table 4.

TABLE 3

| | Binder resin | | | Cleaning roller | |
|---|---|---|---|---|---|
| | Resin | Tg (° C.) | MI (g/10 min, 110° C.) | Resin | MI (g/10 min, 110° C.) |
| Test 7 | Styrene/acryl | 60 | 3 | Styrene/acryl | 5 |
| Test 8 | Polyester | 58 | 7 | Polyester | 10 |
| Test 9 | Styrene/acryl | 60 | 3 | Styrene/acryl | 5 |

TABLE 4

| | At moment when thickness of dirt layer is detected | | After detection | | |
|---|---|---|---|---|---|
| | Thickness of dirt layer (mm) | Cleaner surface temp (° C.) | Cleaner surface temp (° C.) | Heating mechanism | After heating Cleana-bility |
| Test 7 | 2.2 | 60 | 90 | ON | ○ |
| Test 8 | 2.2 | 80 | 90 | ON | ○ |
| Test 9 | 2.2 | 60 | 60 | OFF | X |

As seen from Test samples 7 and 8, by heating the cleaner in the forced cleaning mode as the thickness of the dirt layer was increased to 2 mm or more, thereby removing the dirt layer from the cleaner, it was possible to prolong the life of Test samples 7 and 8 as compared with Test sample 9 where the heating mechanism was not actuated.

Tests 10-13

Samples of developing agents were obtained by repeating the same procedures as in the case of Test 1 except that the binder resins as shown in the following Table 5 were employed in place of the binder resins described in the above Table 1.

Various kinds of cleaners each having a resin covering as shown in the following Table 5 were installed in the fixing device of the image forming apparatus each having the same structures as shown in FIGS. 1 and 2. Then, by making use of the developing agent thus obtained, the formation of images was performed without actuating the heating mechanism.

In this case, the heating mechanism was employed, so that when it was detected that the dirt layer deposited on the surface of cleaner was increased to a thickness of not less than 1 mm and that the surface temperature of cleaner was increased to 80° C., a forced cleaning mode was switched on to thereby heat the cleaner until the surface temperature thereof was raised to 90° C. and, at the same time, the paper was forcibly fed to discharge the dirt layer onto the paper.

The actual thickness of the dirt layer when the dirt layer was detected as having a thickness of not less than 1 mm, the surface temperature of cleaner on this occasion, the surface temperature of cleaner after the detection, and the cleaning properties of cleaner are respectively shown in Table 6.

TABLE 5

| | Binder resin | | | Cleaning roller | |
|---|---|---|---|---|---|
| | Resin | Tg (° C.) | MI (g/10 min, 110° C.) | Resin | MI (g/10 min, 110° C.) |
| Test 10 | Styrene/acryl | 60 | 3 | Styrene/acryl | 5 |
| Test 11 | Polyester | 58 | 7 | Polyester | 10 |
| Test 12 | Styrene/acryl | 60 | 3 | Styrene/acryl | 5 |
| Test 13 | Polyester | 58 | 7 | Polyester | 10 |

TABLE 6

| | At moment when thickness of dirt layer is detected | | After detection | | |
|---|---|---|---|---|---|
| | Thickness of dirt layer (mm) | Cleaner surface temp (° C.) | Cleaner surface temp (° C.) | Heating mechanism | After heating Cleanability |
| Test 10 | 1.5 | 80 | 90 | ON | ○ |
| Test 11 | 2.2 | 80 | 90 | ON | ○ |
| Test 12 | 1.5 | 80 | 80 | OFF | X |
| Test 13 | 2.2 | 80 | 80 | OFF | X |

As seen from Test samples 10 and 11, by heating the cleaner in the forced cleaning mode as the thickness of the dirt layer was increased to 1 mm or more and the surface temperature of cleaner was increased to 80° C. or more, thereby removing the dirt layer from the cleaner, it was possible to prolong the life of Test samples 10 and 11 as compared with Test samples 12 and 13 where the heating mechanism was not actuated.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus comprising:

a developing portion which feeds a developing agent comprising a coloring agent and a binder resin to an electrostatic latent image formed on an image carrier to form a developing agent image on the image carrier;

a transferring portion which transfers the developing agent image to a recording material, and a fixing portion provided with a fixing member which fixes the developing agent image on the recording material and with a cleaning member which is enabled to contact with the fixing member, wherein the cleaning member is provided, on the surface thereof which is adapted to be contacted with the fixing member, with a resinous covering layer comprising a resin which is of the same series as the binder resin and has a melt index which is not less than 1.3 times as high as that of the binder resin.

2. The image forming apparatus according to claim 1, wherein the fixing member is provided with a heating mechanism.

3. The image forming apparatus according to claim 1, wherein the binder resin and the resinous covering layer are selected from at least one kind of resin selected from the group consisting of styrene-acrylic resin, polyester resin, epoxy resin and polyamide.

4. An image forming apparatus comprising:

a developing portion which feeds a developing agent comprising a coloring agent and a binder resin to an electrostatic latent image formed on an image carrier to form a developing agent image on the image carrier;

a transferring portion which transfers the developing agent image to a recording material;

a fixing member which fixes the developing agent image on the recording material, and a cleaning member which is enabled to contact with the fixing member, wherein the cleaning member is provided with a heating mechanism for heating the cleaning member as a layer of dirt that has been deposited on the surface of the cleaning member is increased to a predetermined thickness.

5. The image forming apparatus according to claim 4, wherein the cleaning member is provided, on the surface thereof which is adapted to be contacted with the fixing member, with a resinous covering layer comprising a resin which is of the same series as the binder resin.

6. The image forming apparatus according to claim 5, wherein the binder resin and the resinous covering layer are both selected from at least one kind of resin selected from the group consisting of styrene-acrylic resin, polyester resin, epoxy resin and polyamide.

7. An image forming apparatus comprising:

a developing portion which feeds a developing agent comprising a coloring agent and a binder resin to an electrostatic latent image formed on an image carrier to form a developing agent image on the image carrier;

a transferring portion which transfers the developing agent image to a recording material;

a fixing member which fixes the developing agent image on the recording material, and a cleaning member which is enabled to contact with the fixing member, wherein the cleaning member is provided with a heating mechanism for heating the cleaning member as a layer of dirt that has been deposited on the surface of the cleaning member is increased to a predetermined thickness and also as the temperature of surface of the cleaning member becomes higher than a predetermined level.

8. The image forming apparatus according to claim 7, wherein the cleaning member is provided, on the surface thereof which is adapted to be contacted with the fixing member, with a resinous covering layer comprising a resin which is of the same series as the binder resin.

9. The image forming apparatus according to claim 8, wherein the binder resin and the resinous covering layer are both selected from at least one kind of resin selected from the group consisting of styrene-acrylic resin, polyester resin, epoxy resin and polyamide.

10. A method of forming image comprising:

developing a developing agent image on an image carrier by feeding a developing agent comprising a coloring agent and a binder resin to an electrostatic latent image formed on the image carrier;

transferring the developing agent image to a recording material;

fixing the developing agent image on a recording material by making use of a fixing member;

cleaning dirt on the fixing member by means of a cleaning member which is enabled to contact with the fixing member and provided with a heating mechanism, and heating the cleaning member as a layer of dirt that has been deposited on the surface of the cleaning member is increased to a predetermined thickness;

wherein the cleaning member is provided, on the surface thereof which is adapted to be contacted with the fixing member, with a resinous covering layer comprising a resin which is of the same series as the binder resin and has a melt index which is not less than 1.3 times as high as that of the binder resin.

11. The method of forming image according to claim 10, wherein the fixing member is provided with a heating mechanism.

12. The method of forming image according to claim 11, wherein the binder resin and the resinous covering layer are selected from at least one kind of resin selected from the group consisting of styrene-acrylic resin, polyester resin, epoxy resin and polyamide.

13. A method of forming image comprising:

developing a developing agent image on an image carrier by feeding a developing agent comprising a coloring agent and a binder resin to an electrostatic latent image formed on the image carrier;

transferring the developing agent image to a recording material;

fixing the developing agent image on a recording material by making use of a fixing member;

cleaning dirt on the fixing member by a cleaning member which is enabled to contact with the fixing member and provided with a heating mechanism, and heating the cleaning member as a layer of dirt that has been deposited on the surface of the cleaning member is increased to a predetermined thickness and also as the temperature of surface of the cleaning member becomes higher than a predetermined level.

14. The method of forming image according to claim 13, wherein the cleaning member is provided, on the surface thereof which is adapted to be contacted with the fixing member, with a resinous covering layer comprising a resin which is of the same series as the binder resin and has a melt index which is not less than 1.3 times as high as that of the binder resin.

15. The method of forming image according to claim 14, wherein the binder resin and the resinous covering layer are both selected from at least one kind of resin selected from the group consisting of styrene-acrylic resin, polyester resin, epoxy resin and polyamide.

16. A method of forming image comprising:

developing an image formed of a developing agent on an image carrier by feeding a developing agent comprising a coloring agent and a binder resin to an electrostatic latent image formed in advance on the image carrier;

transferring the developing agent image to a recording material;

fixing the developing agent image on a recording material by making use of a fixing member, and heating the cleaning member as a layer of dirt that has been deposited on the surface of the cleaning member is increased to a predetermined thickness and also as the temperature of surface of the cleaning member becomes higher than a predetermined level.

17. The method of forming image according to claim 16, wherein the cleaning member is provided, on the surface thereof which is adapted to be contacted with the fixing member, with a resinous covering layer comprising a resin which is of the same series as the binder resin and has a melt index which is not less than 1.3 times as high as that of the binder resin.

18. The method of forming image according to claim 17, wherein the binder resin and the resinous covering layer are both selected from at least one kind of resin selected from the group consisting of styrene-acrylic resin, polyester resin, epoxy resin and polyamide.

* * * * *